United States Patent [19]

Cochran

[11] Patent Number: 5,058,672

[45] Date of Patent: Oct. 22, 1991

[54] LANDING COLLAR AND FLOAT VALVE ASSEMBLY

[75] Inventor: Chudleigh B. Cochran, Houston, Tex.

[73] Assignee: Lindsey Completion Systems, Inc., Houston, Tex.

[21] Appl. No.: 566,064

[22] Filed: Aug. 13, 1990

[51] Int. Cl.[5] ..... E21B 23/00; E21B 33/125; E21B 34/10

[52] U.S. Cl. ..... 166/124; 166/148; 166/386; 166/387

[58] Field of Search ..... 166/124, 139, 140, 217, 166/118, 196, 208, 148, 386, 387, 325

[56] References Cited

U.S. PATENT DOCUMENTS

| | | | |
|---|---|---|---|
| 2,228,243 | 1/1941 | Baker | 166/123 X |
| 2,331,532 | 10/1943 | Bassinger | 166/139 |
| 2,754,136 | 7/1956 | Phillips | 277/70 |
| 2,789,925 | 2/1958 | Brown | 166/217 X |
| 2,988,148 | 6/1961 | Conrad et al. | 166/118 X |
| 3,054,450 | 9/1962 | Baker | 166/124 X |
| 3,152,643 | 10/1964 | Burns | 166/124 |
| 3,392,784 | 7/1968 | Brown | 166/139 X |
| 3,393,743 | 7/1968 | Stanescu | 166/139 X |
| 3,460,617 | 8/1969 | Brown et al. | 166/124 |
| 3,631,925 | 1/1972 | Nutter | 166/134 |

*Primary Examiner*—Stephen J. Novosad

[57] ABSTRACT

An assembly for installation within the end of a joint of casing or liner for use in a downhole environment where the liner or casing is disposed in the borehole which traverses earth formations. The assembly includes an annular split ring expander and an annular split ring slip element and a self-energizing packing element which has an interference fit with respect to the bore of a string of pipe. A mechanically operated setting tool has a set of nut members on a threaded mandrel which are selectively operated for setting the slip element of the assembly into a wedging engagement with the expander in the wall of a well pipe and for releasing the setting tool from the body of the assembly to leave the assembly installed within the end of a joint of casing or liner. An expander nut is threadedly coupled to the end of the body of the assembly to lock the slip member in position and the bore of the body is conformed to receive a valve and a landing collar arrangement.

15 Claims, 2 Drawing Sheets

LANDING COLLAR AND FLOAT VALVE ASSEMBLY

RELATED APPLICATION

This application is related to a copending application Ser. No. 566,113, filed Aug. 13, 1990 by the same inventor and is entitled "PIPE INSERT ASSEMBLY".

FIELD OF THE INVENTION

This invention relates to a landing collar and float valve for an oil well liner for use in a borehole traversing earth formations and more particularly to a landing collar and float valve or other piece of equipment which can be inset and attached to a standard piece or joint of liner or casing for use in downhole operations in a well bore and which will hold pressure from above and from below.

BACKGROUND OF THE PRESENT INVENTION

In the completion of oil wells which traverse earth formations, a drilled borehole is lined with one or more strings of pipe called "liners" where each liner is cemented in place with respect to the borehole by an annulus of cement. To cement the liner in the borehole the liner or string of pipe is lowered into the drilled open borehole by means of a liner hanger setting tool and string of pipe used to lower the liner hanger to the position in a casing or liner where the liner hanger is set. The liner hanger is typically set at the lower end of a string of casing or another liner and extends a liner through an open borehole where the liner extends to a location near the bottom of the open borehole. At the open end of the string of pipe is a float shoe and typically two or three pipe joints above the cementing shoe is a float collar which contains a back pressure valve. The float collar typically is a short sub with precision machined threads at each end for coupling in a string of pipe and the collar has a configured interior wall surface which receives a drillable inserted assembly which has a one way check valve. Above the float valve is a landing collar which has a bore section sized to sealingly receive a wiper plug. The landing collar also has a ratchet section in another bore section to receive a locking ratchet on a wiper plug. When the wiper plug is seated in the landing collar it must hold pressure differentials in either direction.

The float collar and the landing collar are expensive items to manufacture and utilize and the present invention involves a structure which can be disposed within the end of an ordinary joint of casing or liner and mechanically actuated by a setting tool to provide a float valve and landing collar into the end of a joint of casing or liner.

SUMMARY OF THE PRESENT INVENTION

The present invention involves an assembly which can be installed in the end of a standard casing or liner for use in a downhole pressure environment where a borehole traverses the earth formations. The assembly can include a float valve and a landing collar wherein the valve includes a tubular body member which is constructed from a lightweight drillable material. An annular elastomer packer member is disposed on the body member between a stationary stop surface on the body member and a movable ring member where the packer member has a hollow interior space between the outer surface of the body member and the inner wall surface of the packer member. Openings are circumferentially disposed and centrally located in the packer member to communicate the exterior of the packer member to the interior wall surface of the packer member. Thus the packer member, which can be slightly larger in diameter than the internal diameter of a standard joint of casing or liner, can be compressed when installed in the end of a joint of pipe and thereby provide an interference compression pressure seal against the inner wall surface of the pipe member. Pressure differential across the packer element will pressure liquid in the interior space to provide a self-energizing sealing element in the bore of the pipe.

A valve means is disposed within the bore of the body member. An annularly shaped split ring expander member is received on the body member where the expander member has an outer tapered surface. An annular split ring slip member has inner frusto conical surfaces which diverge radially outward and where one of the frusto conical surfaces has a complimentary shaped surface to the outer tapered surface on the expander member. The slip member is movable along the tapered surface of the expander member between a first retracted position on the body member and a second extended position in wedging engagement with the wall of the pipe member and expander member. Serrations are provided on the outer surfaces of the body member and the expander member for providing a gripping interrelationship between adjacent parts upon the application of force to a setting position of the slip members. Aside from the packer element the components are made of a drillable material such as aluminum, which is easily removed by a drill bit or a milling tool.

The assembly of the present invention as described above is installed in the end of a pipe or a joint of pipe by a mechanical setting tool which has a threaded mandrel with upper and lower nut members. The lower nut member is attached to a tubular latching collet which has fingers received in an annular recess in the body member. The fingers are held in place by an engaging surface on the setting tool mandrel. The second nut member has a tubular actuating sleeve which engages the split ring slip on the insertable valve assembly. Thus when the setting tool mandrel is held in a fixed position, the second nut can be rotated to move the slip member from a retracted to an extended wall engaging position. After the slip member is in a wedging, gripping relationship to the expander member at the wall of the well pipe, the second nut member can be held fixed and the setting tool mandrel can be rotated to move the locking surfaces from underneath the collet fingers and release the collet finger from the annular recess and the setting tool can be released from the installed valve assembly.

After removing the setting tool, an annular expander nut with an internal thread and an external tapered surface is attachable to a threaded end of the body member and engagable with the frusto conical surface on the slip element to lock the slip against release from pressure differentials in either direction. The internal bore of the body member above the valve is provided with a sealing bore and a latching bore to sealing receive and lock a wiper plug in the assembly.

The operation can be conducted simply, swiftly and economically on the ground surface at the well site location prior to running the string of liner into the well bore.

DESCRIPTION OF THE PRESENT INVENTION

Figure 1:
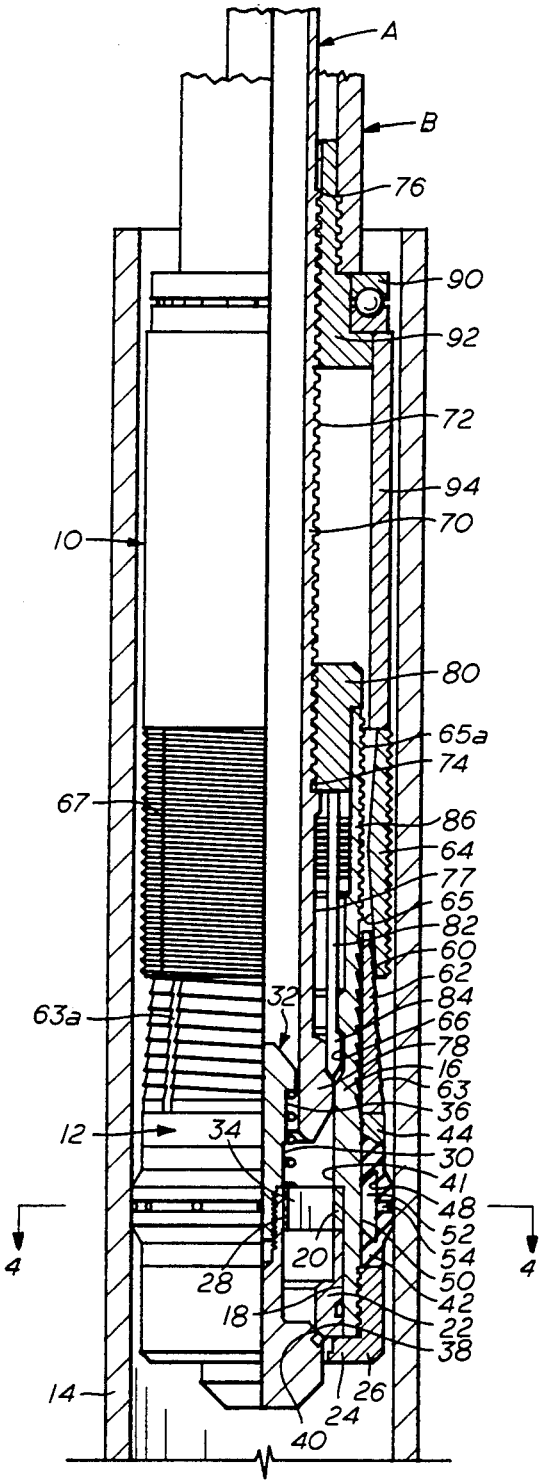
FIG. 1 is a view in partial longitudinal cross section of an insert assembly and setting tool in a casing or liner pipe.

Referring now to the drawings, FIG. 1 illustrates a setting tool assembly 10 and an insert assembly 12 of the present invention disposed in a section of pipe 14. The insert assembly 12 includes a tubular central body member 16 constructed from a light weight drillable material such as an aluminum alloy. At one end of the body member 16 is an internal counterbore 18 which receives an annular disc member 20 and a tubular valve seat member 22. The disc member 20 and the valve seat member 22 are retained in the counterbore 18 by a flange 24 on a tubular cap member 26 which is threadedly attached to one end of the body member 16. The disc member 20 has a central bore 28 which slidably receives a valve stem 30 of a valve element 32. A number of peripherally disposed, individual openings 34 in the disc member 20 provide fluid communication passages through the disc member 20. A spring 36 is disposed between the disc member 20 and a flange on the valve stem 30 so that the spring resiliently urges the valve stem 30 toward the other end of the body member 16. At one end of the valve stem 32 is a valve surface 38 which sealingly engages a valve seat 40 in the valve seat member 22. Liquid under pressure within the bore 41 of the body member 16 can be in excess of the pressure externally of the body member 16 to move the valve surface 38 from the valve seat 40 and bypass or pass liquid through the valve. On the other hand, liquid under pressure in a location in the pipe 14 external to the body member 16 will not move the valve surface 38 from the valve seat 40 and open the valve.

An annular elastomer sealing element 42 is disposed on the body member 16 in a location between the cap member 26 and an annular packer ring 44. The packer ring 44 is threadedly attached to the body member 16. The sealing element 42 has an inner wall surface 48 spaced from the outer wall surface 50 of the body member 16 to define an annular pressure space 52. The wall of the sealing element 42 has circumferentially arranged ports 54 located midway between the axial length of the sealing element 42. The outer diameter of the sealing element 42 relative to the internal diameter of the pipe 14 is sized so that the sealing element 42 has an interference fit within the bore of the pipe 14. For example, a diameter of the sealing element one-fourth inch larger than the bore diameter for a 4 inch pipe has been found suitable.

When the sealing element 42 is in the bore of a pipe member 14, liquid under pressure from below the sealing element 42 can communicate with the space 52 through the openings 54 in the sealing element 42 and act upon the upper annular portion of the sealing element 42 to provide a self energizing seal. Similarly, if liquid under pressure from above the sealing element 42 communicates with the space 52 through the openings 54 in the sealing element, such pressure will act upon the lower annular portion of the sealing element to provide a self energizing seal.

The portion of the mandrel body 16 located above the ring member 44 has a length of serrated body portion 60 which is located below an annularly shaped expander member 62. The expander member 62 has a longitudinal split 63*a* so that it is a split ring with an outer frusto conical surface 63.

Adjacent to the expander element 62 in a first retracted position is a split ring slip element 64. A first inner frusto conical surface 65 located in the lower part of the slip element 64 extends partially over an end portion of the outer frusto conical surface 63 on the expander element 62. The slip element has a longitudinal split 67. A second inner frusto conical surface 65*a* is located in the upper part of the slip element 64. The surfaces 65, 65*a* diverge outwardly from a central location in the slip element.

The setting tool assembly 10 is mechanically attached to an annular recess 66 which is located in the bore 41 of the body member 16. The setting tool assembly 10 includes a setting tool central mandrel 70 which has an intermediate length portion with a right hand thread 72 extending between a first location 74 and a second location 76 on the mandrel. To one side of the first location 74, the setting tool mandrel 70 has a recessed cylindrically shaped portion 77 and an enlarged cylindrically shaped portion 78. A first nut member 80 is located and threadedly connected to the mandrel 70 at the first location 74. The first nut member 80 has a depending tubular collet member 82 with collet lugs 84 disposed and retained in the annular recess 66 by the enlarged lower portion 78 of the setting tool mandrel. The collet member 82 is formed by circumferentially arranged, elongated resilient fingers formed by longitudinal slots in the collet member.

The first nut member 80 also has a depending recess 86 which receives the seal bore 86*a* in the upper end of the body member 16. A shoulder on the nut member 80 engages the end of the body member 16. The engaging ends of the body member 16 and the nut member 80 can have clutch or serration teeth to impede rotation of the nut 80.

When the setting tool mandrel 70 is rotated relative to the first nut member 80, for example, by a pipe wrench applied at location A while another pipe wrench is applied at B in the opposite direction of rotation, the enlarged cylindrical portion 78 on the setting tool mandrel 70 is longitudinally moved from a position retaining the collet lugs 84 in the annular recess or groove 66 in the body member 16 to a location where the cylindrically recessed portion 77 of the mandrel is disposed adjacent to the collet lugs 84 so that the collet lugs 84 are disconnectable from the annular recess 66 in the tool body member. (See FIG. 3)

At the second location 76 of the thread on the setting tool mandrel is a second nut member 90. The second nut member 90 is connected by a rotating bearing 92 to a tubular slip driver 94 which engages the end of the slip element 64. By holding the mandrel 70 at location A and rotating the second nut member 90 relative to the mandrel 70 by rotation at location B, the slip driver 94 moves the slip element 64 into wedging engagement with the slip expander 64 and the inner wall of the pipe 14. (See FIG. 2)

After setting the slip member 64 in the pipe 14, the setting tool 10 is disconnected from the assembly 12 by rotating the setting tool mandrel 70 and longitudinally moving the enlarged cylindrical portion 78 from its retaining position to a position where the released portion 77 releases the collet lugs 84 from the recess 66. The setting tool can then be removed from the pipe.

Figure 3:
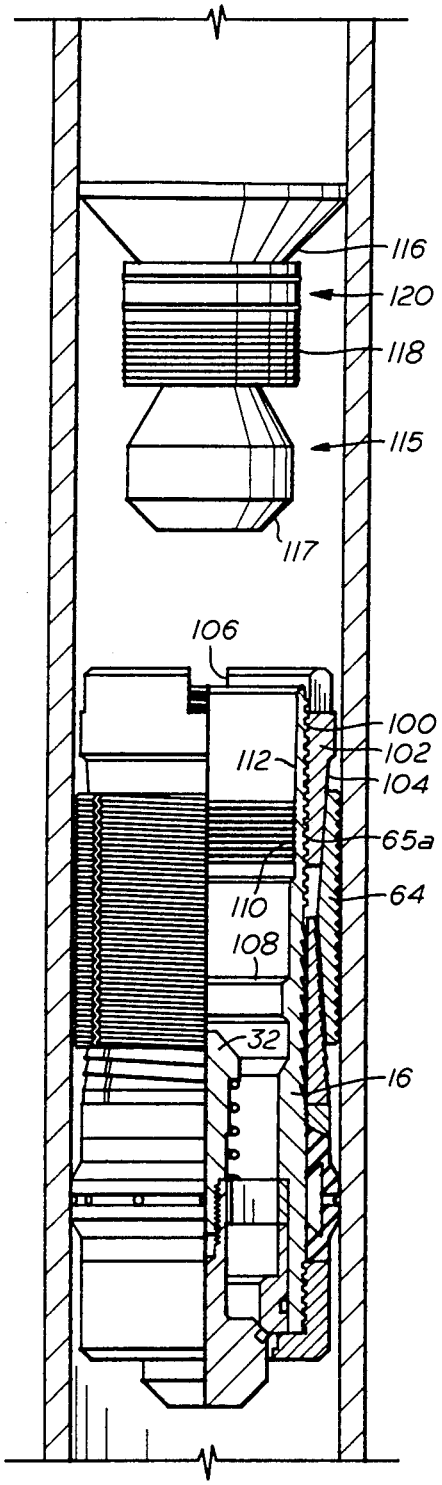
FIG. 3 is a view similar to FIG. 2 and illustrating the parts in position after the setting tool is released and after the lock nut is applied.
Figure 4:
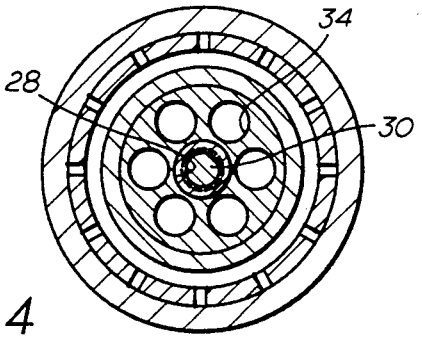
FIG. 4 is a cross section view taken along line 4—4 of FIG. 1.

As shown, for example, in FIG. 3, the upper end of the body member 16 has an external threaded section 100 which threadedly receives a locking expander nut 102. The expander nut 102 has an external tapered surface 104 to engage the internal tapered surface 65*a* on the slip member 64 and thus the slip member 64 and the body member 16 are locked against movement in both directions. The upper end of the expander nut 102 has lug recesses 106 which can receive lugs on a turning wrench (not shown).

The inner bore of the body member 16 above the valve 32 includes an upwardly facing landing shoulder 108, a ratchet section 110 and a smooth sealing bore 112. When the assembly is in a pipe 14 in a well bore, a conventional cementing plug 115 with sealing cups 116 can be pumped through the string of pipe until the plugs nose 117 engages the landing seat 108 where ratchet members 118 on the plug lock into engagement with the ratchet section 110 and sealing means 120 on the plug seal in the sealing bore 112.

In operation and use, the setting tool assembly 10 is connected to the inset valve assembly 12. For interconnection the second nut member 90 is removed while the first nut member 80 is located so that the collet lugs 84 are adjacent to the mandrel recess 77 and so that the setting tool mandrel 72 is insertable into the open end of a inset valve assembly 12 until the nut 80 engages the end of the body member 16 which positions the collet lugs 84 adjacent to the valve mandrel recess 77. The setting tool mandrel 70 is then rotated relative to the first nut member 74 to locate the enlarged mandrel portion 78 in contact with the collet lugs 84 to lock to lugs 84 in the valve mandrel recess 66. The second nut member 90 is then threaded into the setting tool mandrel 70 to bring the slip driver 94 in touching engagement with the slip member 64 as shown in FIG. 1.

Figure 2:
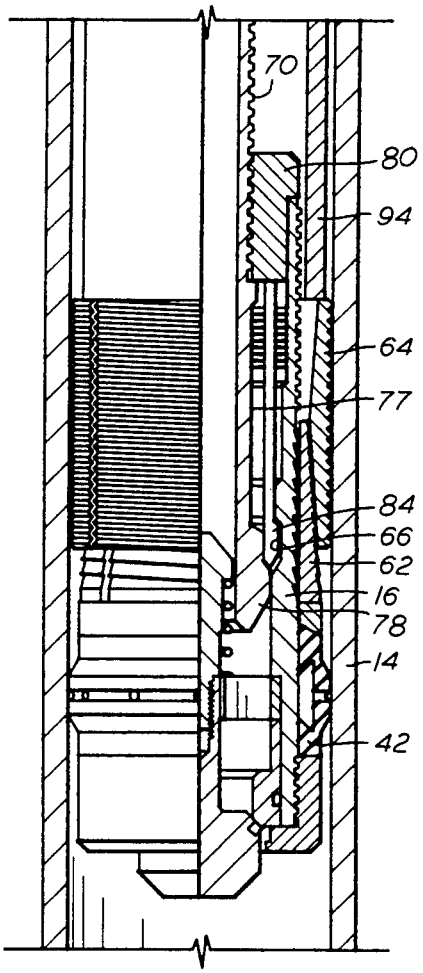
FIG. 2 is a view similar to FIG. 1 and illustrating the parts in position when the slip element is set.

The valve assembly 12 is then installed in the end of a pipe member 14 as shown in FIG. 1. In the installation, the packer element 52 is compressed by virtue of the interference fit. As shown in FIG. 2, the second nut member 90 is then rotated while the setting tool mandrel 70 is held immovable. This produces a longitudinal motion of the slip driver 94 which moves the split slip element 64 to an expanded or extended condition between the inner wall of the pipe 14 and the outer serrated surface 63 of the expander member 62. In the extended position of the slip element 64 the outer serrated surface of the slip element 64 provides gripping edges with the pipe wall, the serrated surface 63 provides gripping edges with the expander 62, and the outer serrated portion 60 of the mandrel 16 provides gripping edges relative to the expander element 62. The elements being constructed from aluminum are relatively soft and can deform somewhat. The openings 54 in the packer element 42 provide a self sealing action by virtue of fluid pressure transmittal to the interior space 52 in a packer element.

After the inset assembly 12 is set in the bore of the pipe 14, as shown in FIG. 2, the mandrel 70 is next rotated relative to the first nut member 80 so that the enlarged portion 78 on the mandrel 70 is moved from a position supporting the collet lugs 84 to a position where the recess 77 permits release of the collet lugs 84 from the recess 66. When the collet lugs 84 are released from the recess 66 the setting tool is releasable from the set valve assembly 12.

Next, the expander nut 102 is threadedly attached to the end of the body member to lock the expander member 64 against movement in either direction.

Figure 5:
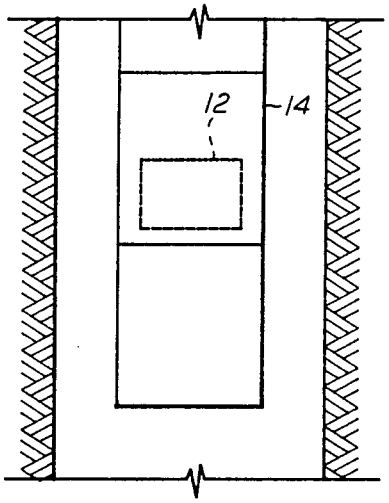
FIG. 5 is a schematic view of a pipe with the installed assembly in a well bore.
Figure 6:
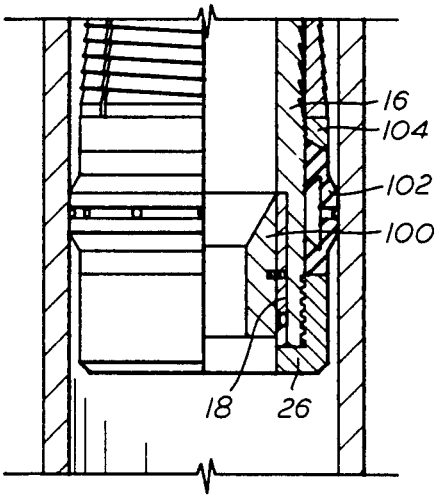
FIG. 6 is a partial view in cross section of another form of present invention.

As shown in FIG. 5, the pipe 14 with an inset assembly 12 is connectable in a string of pipe or liner to be utilized in a borehole.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A setting tool and valve unit assembly for installation of the valve unit in the end of a joint of casing or liner for use of the casing or liner with the installed valve unit in a downhole pressure environment where a borehole traverses earth formation, said valve unit comprising a tubular body member constructed from a light weight drillable material;

an annular elastomer packer member disposed on said body member, said packer member having a hollow annular interior between the outer wall surface of the body member and an inner wall surface of said packer member, said packer member having access openings communicating the exterior of said packer member to the interior wall surface, said access openings being disposed circumferentially around said packer member and located midway of the length of the packer member, said packer member being sized for an interference fit in a casing or liner;

valve means disposed within the bore of said body member;

said body member having an annularly shaped expander member received on said body member, said expander member having an outer tapered surface;

an annularly shaped split ring slip member having internal upper and lower tapered surfaces diverging outwardly from a central location, said lower surface being engageable with said expander member, said slip member being movable between a first retracted position and a second extended position and in said extended position providing a wedging engagement with the wall of a well pipe and the expander member, an annular nut expander member threadedly attachable to the upper end of said body member, said expander member having a tapered surface for engaging said upper tapered surface of said slip member for locking said slip member in a set position;

latching means on said body member for latching to a setting tool member;

said setting tool including a tubular setting tool mandrel having an external thread extending between first and second longitudinally spaced locations;

a tubular latching member having an internally threaded nut member at a first longitudinal position on said tool mandrel when said first longitudinal position is located adjacent to the end of said tool mandrel, said nut member having a tubular latching collet with retaining lugs for cooperation with said latching means where said latching means is an internal annular recess and said retaining lugs are retained in said internal annular recess by an enlarged diametrical portion on said setting tool mandrel, said nut member having a tubular sleeve member for engaging with an end of said valve body member;

a second internally threaded nut member located at said second location whereby rotation of said second nut member relative to said setting tool mandrel produces longitudinal movement of said slip member from said first position toward said second positron for urging said slip member into wedging engagement with the internal wall of a pipe member and whereby subsequent rotation of said setting tool mandrel relative to said second nut member produces a longitudinal motion of said setting tool mandrel from said first location for moving a recessed diametrical portion on said setting tool mandrel adjacent to said retaining lugs for releasing said retaining lugs from said internal annular recess.

2. The apparatus as set forth in claim 1 wherein said lower tapered surface located between said expander member and said slip member is serrated.

3. The apparatus set forth in claim 2 wherein said expander member is a split ring member and said expander member is disposed over a serrated surface on said tubular body member.

4. The apparatus as set forth in claim 3 wherein said packer member is disposed between a stationary stop surface on said body member and a stationary ring member on said body member.

5. The apparatus as set forth in claim 1 wherein said body member has a landing seat, a ratchet coupling means and a sealing bore for receiving a cementing plug.

6. A setting tool and insert assembly for installation of the insert in the end of a joint of casing or liner for use of the casing or liner in a downhole environment where a borehole traverses earth formation, said insert comprising a tubular body member constructed from a light weight drillable material;

an annular elastomer packer member disposed on said body member, said packer member having a hollow annular interior between the outer wall surface of the body member and an inner wall surface of said packer member, said packer member having access openings communicating the exterior of said packer member to the interior wall surface, said access openings being disposed circumferentially around said packer member and located midway of the length of the packer member, said packer member being sized for an interference fit in the casing or liner;

said body member having an annularly shaped split ring expander member received on said body member, said expander member having an outer tapered surface;

an annularly shaped split ring slip member having internal upper and lower tapered surfaces diverging outwardly from a central location, said lower surface being engageable with said expander member, said slip member being movable between a first retracted position and a second extended position and in said extended position providing a wedging engagement with the wall of a well pipe and the expander member, an annular nut expander member threadedly attachable to the upper end of said body member, said expander member having a tapered surface for engaging said upper tapered surface of said slip member for locking said slip member in a set position;

latching means on said body member for latching to a setting tool member;

said setting tool including a tubular setting tool mandrel having an external thread extending between first and second longitudinally spaced locations;

a tubular latching member having an internally threaded nut member at a first longitudinal position on said tool mandrel when said first longitudinal position is located adjacent to the end of said tool mandrel, said nut member having a tubular latching collet with retaining lugs for cooperation with said latching means where said latching means is an internal annular recess and said retaining lugs are retained in said annular recess by an enlarged diametrical portion on said setting tool mandrel, said nut member having a tubular sleeve member for engaging with an end of said valve body member; and a second internally threaded nut member located at said second location whereby rotation of said second nut member relative to said setting tool mandrel produces longitudinal movement of said slip member from said first position toward said second position for urging aid slip member into wedging engagement with the internal wall of a pipe member and whereby subsequent rotation of said setting tool mandrel relative to said second nut member produces a longitudinal motion of said setting tool mandrel from said first location for moving a recessed diametrical portion on said setting tool mandrel adjacent to said retaining lugs for releasing said retaining lugs from said internal annular recess.

7. The apparatus as set forth in claim 2 wherein said lower tapered surface located between said expander member and said slip member is serrated.

8. The apparatus set forth in claim 2 wherein said expander member is disposed over a serrated surface on said tubular body member.

9. The apparatus as set forth in claim 8 wherein said packer member is disposed between a stationary stop surface on aid body member and a stationary ring member on said body member.

10. The apparatus as set forth in claim 2 wherein said body member has a landing seat, a ratchet coupling means and a sealing bore for receiving a cementing plug.

11. A setting tool and insert assembly for installation of the insert in the end of a joint of casing or liner for use of the casing or liner in a downhole environment where a borehole traverses earth formation, said insert comprising a tubular body member constructed from a light weight drillable material;

an annular elastomer packer member disposed on said body member between an expander member and a shoulder on said body member for sealing with a pipe wall;

said expander member being an annularly shaped split ring received on said body member, said expander member having an outer tapered surface;

an annularly shaped split ring slip member having internal upper and lower tapered surfaces diverging outwardly from a central location, said lower surface being engageable with said expander member, said slip member being movable between a first retracted position and a second extended position and in said extended position providing a wedging engagement with the wall of a well pipe and the expander member, an annular nut expander member threadedly attachable to the upper end of said body member, said expander member having a tapered surface for engaging said upper tapered surface of said slip member for locking said slip member in a set position;

latching means on said body member for latching to a setting tool member;

said setting tool including a tubular setting tool mandrel having an external thread extending between first and second longitudinally spaced locations;

a tubular latching member having an internally threaded nut member at a first longitudinal position on said tool mandrel when said first longitudinal position is located adjacent to the end of said tool mandrel, said nut member having a tubular latching collet with retaining lugs for cooperation with said latching means where said latching means is an internal annular recess and said retaining lugs are retained in said internal annular recess by an enlarged diametrical portion on said setting tool mandrel, said nut member having a tubular sleeve member for engaging with an end of said valve body member;

a second internally threaded nut member located at said second location whereby rotation of said second nut member relative to said setting tool mandrel produces longitudinal movement of said slip member from said first position toward said second position for urging said slip member into wedging engagement with the internal wall of a pipe member and whereby subsequent rotation of said setting tool mandrel relative to said second nut member produces a longitudinal motion of said setting tool mandrel from said first location for moving a recessed diametrical portion on said setting tool mandrel adjacent to said retaining lugs for releasing said retaining lugs from said internal annular recess.

12. The apparatus as set forth in claim 11 wherein said lower tapered surface located between said expander member and said slip member is serrated.

13. The apparatus set forth in claim 12 wherein said expander member is disposed over a serrated surface on said tubular body member

14. The apparatus as set forth in claim 13 wherein said packer member is disposed between a stationary stop surface on said body member and a stationary ring member on said body member.

15. The apparatus as set forth in claim 11 wherein said body member has a landing seat, a ratchet coupling means and a sealing bore for receiving a cementing plug.

* * * * *